US006539564B1

(12) United States Patent
Hsia

(10) Patent No.: US 6,539,564 B1
(45) Date of Patent: Apr. 1, 2003

(54) LIGHTWEIGHT CHILDBED CONSTRUCTED WITH GAPLESS SIDE PANEL

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 0 days.

(21) Appl. No.: 09/976,595

(22) Filed: Oct. 12, 2001

(51) Int. Cl.[7] ..... A47C 19/00

(52) U.S. Cl. ..... 5/110; 5/112; 5/187; 5/193; 5/131

(58) Field of Search ..... 5/110, 111, 112, 5/131, 187, 280, 53.1, 724, 193

(56) References Cited

U.S. PATENT DOCUMENTS 1,820,285 A * 8/1931 Mills ..... 5/114
3,805,367 A * 4/1974 Hasty ..... 29/448
4,688,281 A * 8/1987 Lantz ..... 5/111
4,821,349 A * 4/1989 Cohen ..... 5/183
5,978,992 A * 11/1999 Antinori ..... 5/193

* cited by examiner

*Primary Examiner*—Michael F. Trettel
(74) *Attorney, Agent, or Firm*—Raymond Y. Chan; David and Raymond Patent Group

(57) ABSTRACT

A lightweight childbed includes a supporting panel including a first layer having a tension surface and a second layer overlapped with the first layer to define an edge holder therebetween, at least a side panel including a first sheet having a tension portion and a second sheet overlapped with the first sheet to define a receiving groove therebetween, and a bed frame including a boundary flame defining a central main window and adapted to be fittedly received in the edge holder so as to mount the first layer covering the main window to form the tension surface, and at least a side frame, which is mounted on a longitudinal side of the boundary frame, defining a central side window and adapted to be fittedly received in the receiving groove so as to mount the first sheet covering the side window to form the tension portion.

13 Claims, 6 Drawing Sheets

LIGHTWEIGHT CHILDBED CONSTRUCTED WITH GAPLESS SIDE PANEL

BACKGROUND OF THE PRESENT INVENTION

1. Field of Invention

The present invention relates to a childbed, and more particularly to a lightweight childbed constructed with gapless side panel, wherein the childbed comprises a fabric made supporting panel such that a downward force of a user's weight can be evenly distributed on the tensioned supporting panel.

2. Description of Related Arts

Referring to FIG. 1, a conventional childbed comprises a bed frame and a supporting board for supporting a user thereon. The bed frame generally comprises a main frame for supporting the supporting board thereon and two head frames rigidly mounted on two opposed longitudinal sides of the main frame respectively.

In order to support the supporting board, the main frame comprises a surrounding rim and a plurality of supporting bars spaced parallel on the surrounding rim. However, the surrounding rim and the supporting bars highly increase the overall weight of the childbed. Moreover, each of the head frame is made of a piece of wooden board which may reduce the ventilation of the childbed. Thus, since the head frame is opaque, the young child may feel scare and unsafe while he or she is sleeping. Alternatively, the head frame comprises a plurality of guiding bars spacedly provided for ventilation and see-through purpose. However, it is very dangerous that the young child may get stuck between two guiding bars, which may cause an unwanted serious injury to the young child.

Usually, the supporting board is made of wood or is a cardboard that can support the user such as a young child thereon. However, the conventional supporting board has several drawbacks.

The supporting board is bulky and heavy for storage and transportation. In order to provide a rigid structure for supporting the user's weight, the supporting board must be constructed to have a high tension-supporting surface. It is worth to mention that the tension-supporting surface provides a predetermined tension force evenly distributed thereon, wherein when the downward force, that is the user's weight, is greater than the tension force, the supporting board will be cracked or even broken.

Especially for the childbed, the young child may jump on the supporting board. Since the supporting board is rigid but not flexible, the concentrated downward force exerted on the supporting board may crack it easily. Therefore, the rigid supporting board may not be the best solution for the childbed.

Some supporting boards made of cardboard include a lightweight feature can be easily and quickly unfolded for use and fold into a compact unit for carriage. However, the fold-up structure of the supporting board cannot provide the high tension-supporting surface. In other words, such supporting boards cannot rigidly support the user thereon.

Moreover, since the supporting board is made of wood, which is one of the most valuable raw resources in the world, it is unreasonable to keep wasting the resource until it may be used up one day. So, an alternative is seeking for.

SUMMARY OF THE PRESENT INVENTION

A main object of the present invention is to provide a lightweight childbed constructed with gapless side panel, wherein the supporting panel and the two side panels are all constructed with fabric material in a specific way that not only provides strengthened tension surface to support weight but also allows light passing through.

Another object of the present invention is to provide a lightweight childbed constructed with gapless side panel, wherein the supporting panel is constructed to support a user's weight in an evenly distributed manner.

Another object of the present invention is to provide a lightweight childbed constructed with gapless side panel, wherein each of the supporting panel and the side panels has an elastic ability for providing a high tension-supporting surface, so as to enhance the durability of the supporting panel.

Another object of the present invention is to provide a lightweight childbed constructed with gapless side panel, wherein each of the supporting panel and the side panels provides a substantial support without altering or complicating the original structure of the bed frame.

Another object of the present invention is to provide a lightweight childbed constructed with gapless side panel, wherein no expensive or mechanical structure is required to employ in the present invention in order to achieve the above mentioned objects. Therefore, the present invention successfully provides an economic and efficient solution for providing reinforced supporting configuration to the user supported on the childbed.

Accordingly, in order to accomplish the above objects, the present invention provides a lightweight childbed, comprising:

a supporting panel comprising a first layer having a tension surface and a second layer overlapped with the first layer to define an edge holder having an opening between the first and second layers, wherein a tension of the tension surface is larger than a weight to be supported by the supporting panel;

at least a side panel comprising a first sheet having a tension portion and a second sheet overlapped with the first sheet to define a receiving groove between the first and second sheets; and a bed frame, which comprises a boundary frame defining a central main window and having a size and shape adapted to be fittedly received in the edge holder so as to mount the first layer to cover the main window to form the tension surface, and at least a side frame, which is mounted on a longitudinal side of the boundary frame, defining a central side window and having a size and shape adapted to be fittedly received in the receiving groove so as to mount the first sheet to cover the side window to form the tension portion.

DETAILED DESCRIPTION OF THE PREFERRED EMBODIMENT

Figure 1:
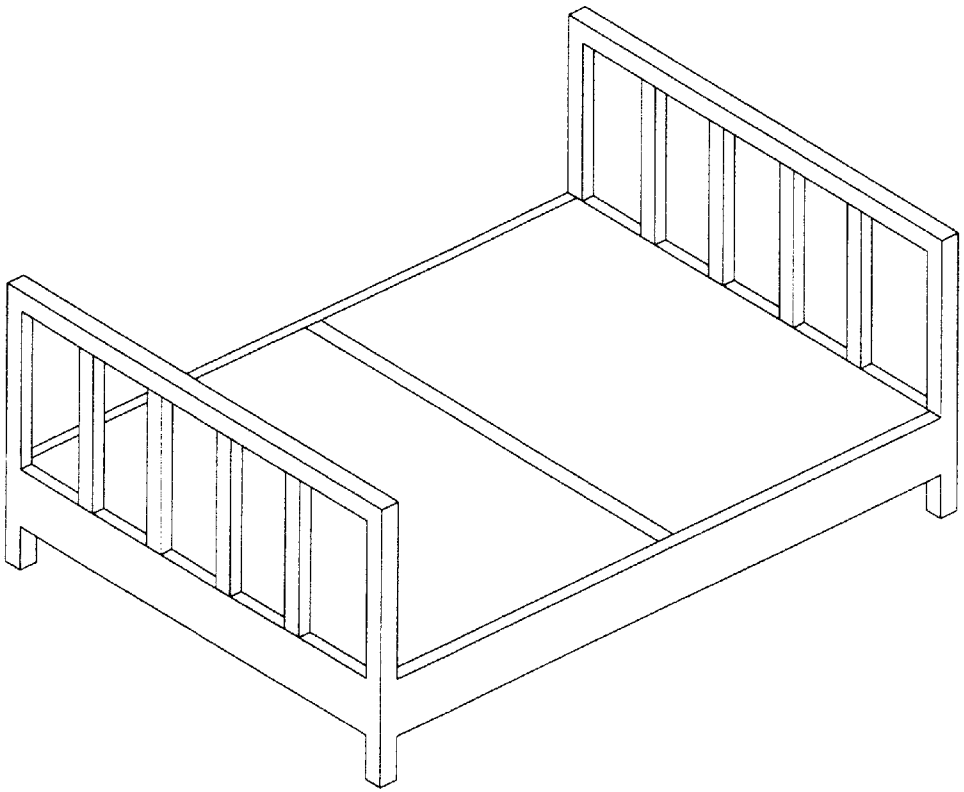
FIG. 1 is a perspective view of a conventional childbed.
Figure 2:
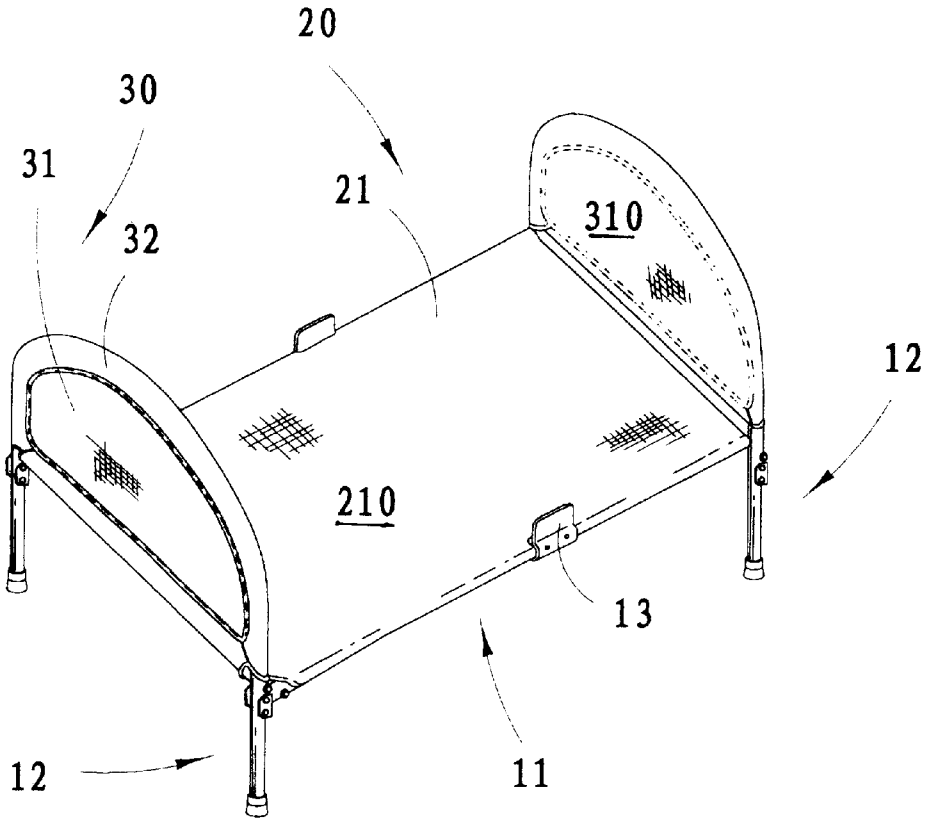
FIG. 2 is a perspective view of a lightweight childbed with gapless side panel according to a preferred embodiment of the present invention.
Figure 3:
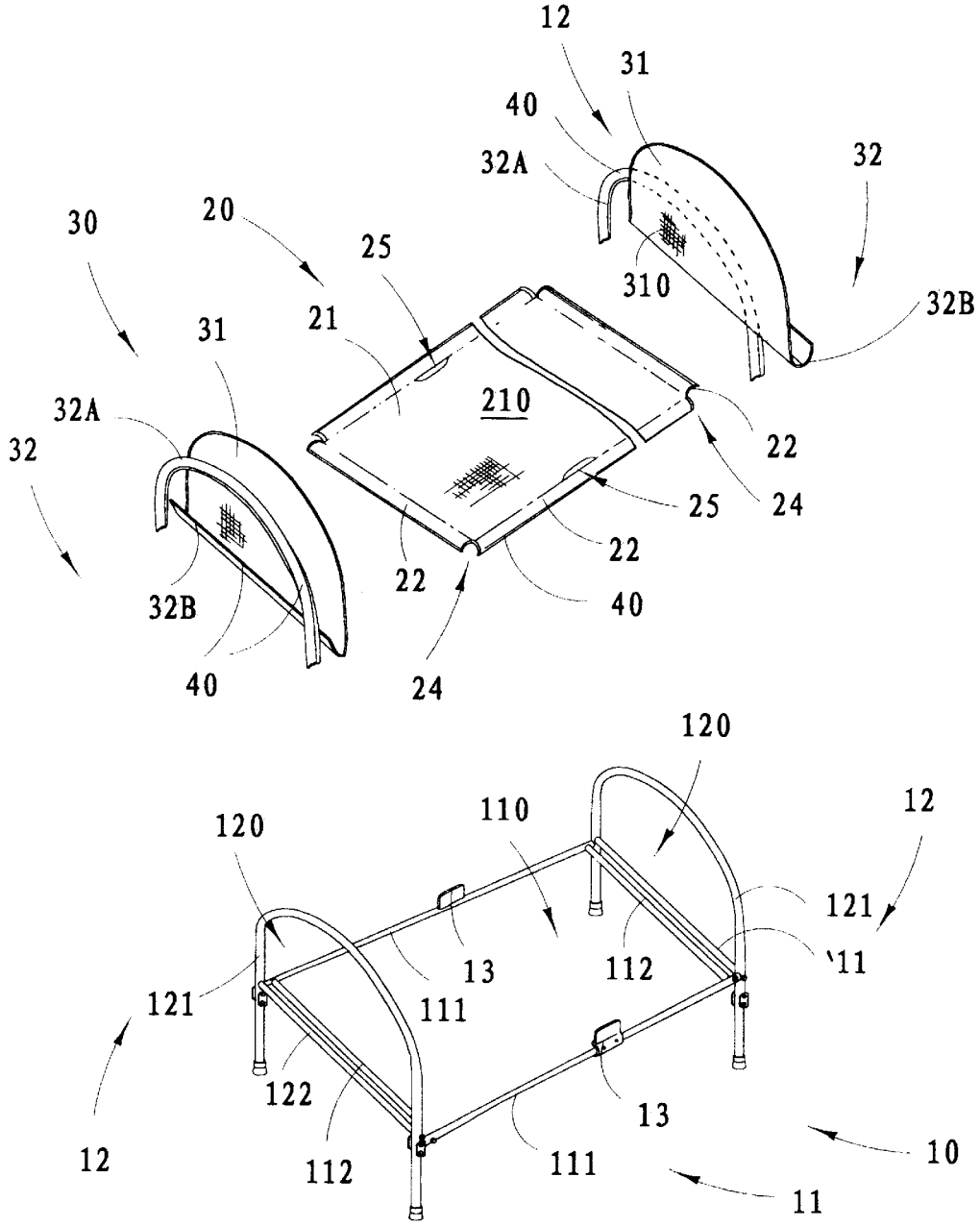
FIG. 3 is an exploded perspective view of the lightweight childbed with gapless side panel according to the above preferred embodiment of the present invention.

Referring to FIGS. 2 and 3 of the drawings, a lightweight childbed with gapless side panel according to a preferred embodiment of the present invention is illustrated, wherein the childbed comprises a bed frame 10 which includes a boundary frame 11, at least a side frame 12, a supporting panel 20 mounted on the boundary frame 11, and a side panel 30 mounted on the side frame 12.

The supporting panel 20 comprises a first layer 21 having a tension surface 211 and a second layer 22 overlapped with the first layer 21 to define an edge holder 23 between the first and second layers 21, 22. The edge holder 23 has a holder opening 231. A tension of the tension surface 211 must be larger than a weight to be supported by the supporting panel 20.

The side panel 30, which is mounted on a longitudinal side of the boundary frame 20, comprises a first sheet 31, which has a tension portion 311, and a second sheet 32, which is overlapped with the first sheet 32 to define a receiving groove 33 between the first and second sheets 31, 32. The receiving groove 33 has a groove opening 331.

The boundary frame 11, which defines a central main window 110, has a size and shape adapted to be fittedly received in the edge holder 23 so as to mount the first layer 21 to cover the main window 110 to form the tension surface 211.

The side frame 12, which defines a central side window 120, has a size and shape adapted to be fittedly received in the receiving groove 33 so as to mount the first sheet 31 to cover the side window 120 to form the tension portion 311.

According to the preferred embodiment, the boundary frame 11 comprises two pairs of supporting arms 111, 112 connected end to end to form a rectangular structure that supports the supporting panel 20 in a corresponding rectangular shape, wherein the main window 110 is defined between the four supporting arms 111, 112.

As shown in FIG. 3, there are two side frames 12 mounted on two opposing longitudinal sides of the boundary frame 11. Each of the side frames 12 comprises a U-shaped supporting post 121, which has two downwardly extending support stands firmly connected to two ends of the two first supporting arms 111, and a supporting pillar 122 transversely mounted between two support stands of the supporting post 121 to define the side window 120 therebetween.

According to the preferred embodiment, the supporting panel 20 and the side panel 30 are made of lightweight and durable fabric material, such as mesh fabric or nylon, for evenly supporting a downward force of a user's weight applied on the supporting panel 20. The sheet material for making the web of trampoline is also suitable for making the supporting panel 20. Other elastic and durable sheet materials are usable too.

Figure 4:
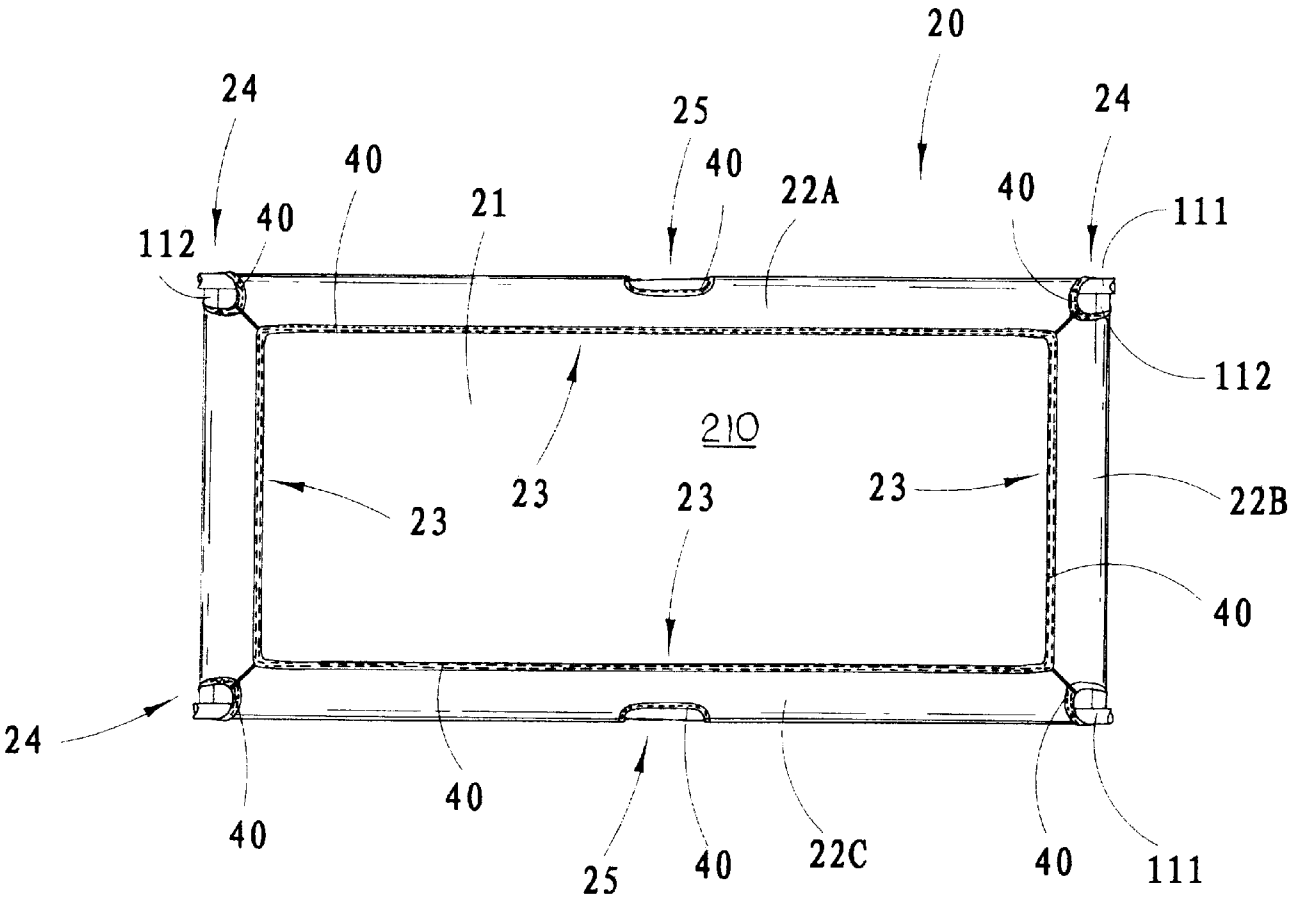
FIG. 4 is a bottom view of the lightweight childbed with gapless side panel according to the above preferred embodiment of the present invention.

The first and second layers 21, 22 of the supporting panel 20 forms the corresponding rectangular size, which are overlappedly extended side to side together to define the edge holder 23 that has a U-shaped cross section between the first and second layers 21, 22. Accordingly, in order to form the edge holder 23 to receive the boundary frame 11, the second layer 22 is formed by folding four outer edges of the first layer 21 to a bottom surface thereof overlappedly, so as to form four edge sections 22A, 22B, 22C, 22D of the second layer 22, which are connected together end to end to form a pocket-like supporting panel 20, wherein four edge holders 23 are formed between the four edge sections 22A~D of the second layer 22 and the first layer 21 respectively and the respective edge opening 231 opens inwardly, as shown in FIG. 4. In other words, four outer circumferential edges of the edge sections 22A~D of the second layer 22 are integrally connected to four outer circumferential edges of the first layer 21 respectively.

Figure 5:
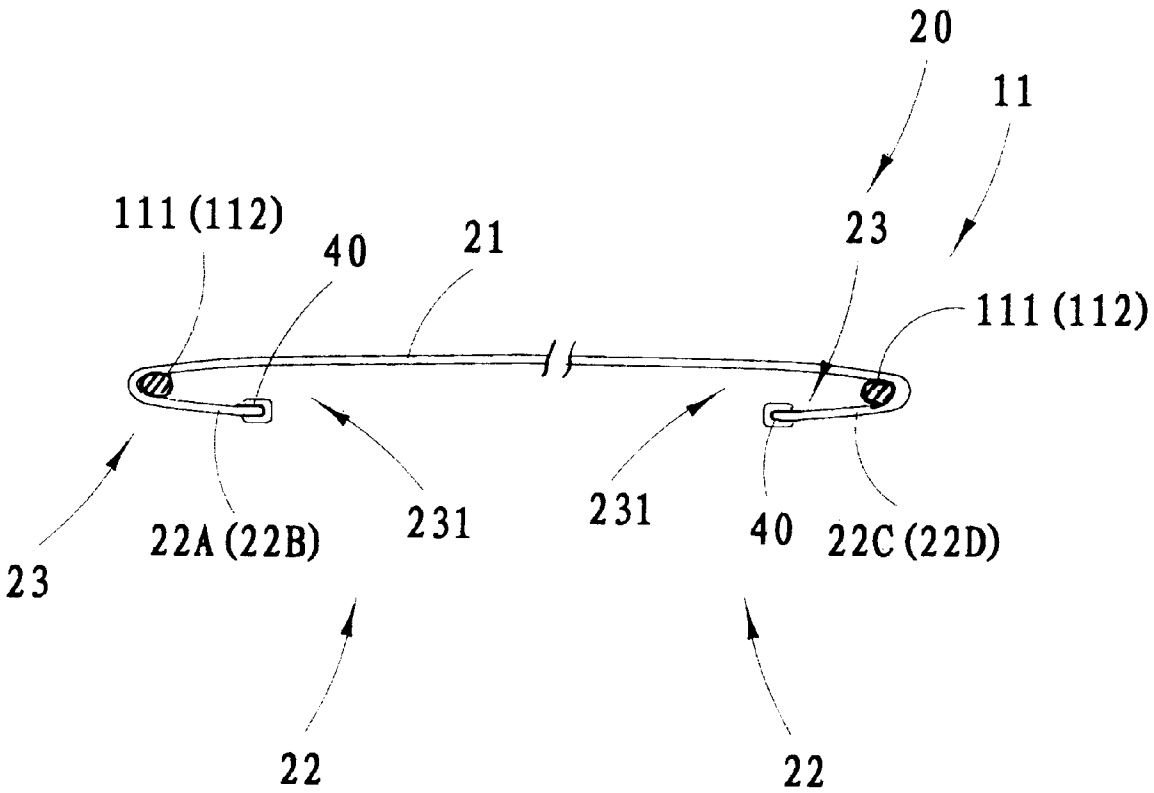
FIG. 5 is a sectional view of the lightweight childbed with gapless side panel according to the above preferred embodiment of the present invention.

Referring to FIG. 5, when the supporting arms 111, 112 of the boundary frame 11 are received in the edge holder 23 of the supporting panel 20 respectively, the tension surface 211 of the supporting panel 20 will be stretched aside in order to increase the tension of the supporting panel 20 within the tension surface 211. Moreover, the supporting panel 20 is retained on the boundary frame 11 in position. In order to increase the tension within the tension surface 211 of the supporting panel 20 within the tension surface 211, the four edge sections 22A~D can be stretched outwardly and attached together end to end.

As shown in FIG. 4, the supporting panel 20 further has four corner notches 24 provided at four corners of the second layer 22 for registering with the boundary frame 11 wherein each corner notch 24 is formed at an end connection between two of the adjacent edge sections 22A~D of the second layer 22.

In order to prevent the distortion of the supporting panel 20, the childbed further comprises at least an edge protecting strap 40 attached to the second layer 22 along the holder opening 231 wherein the edge protecting strap 40 is capable of strengthening the second layer 22 of the supporting panel 20 so as to prevent the second layer 22 from tearing off by tension. Accordingly, there are four edge protecting straps 40 attached to the four edge sections 22A, 22B, 22C, 22D of the second layer 22 respectively. Thus, the edge protecting strap 40 is attached to edges of each corner notch 24 to enhance the strength thereof.

Figure 6:
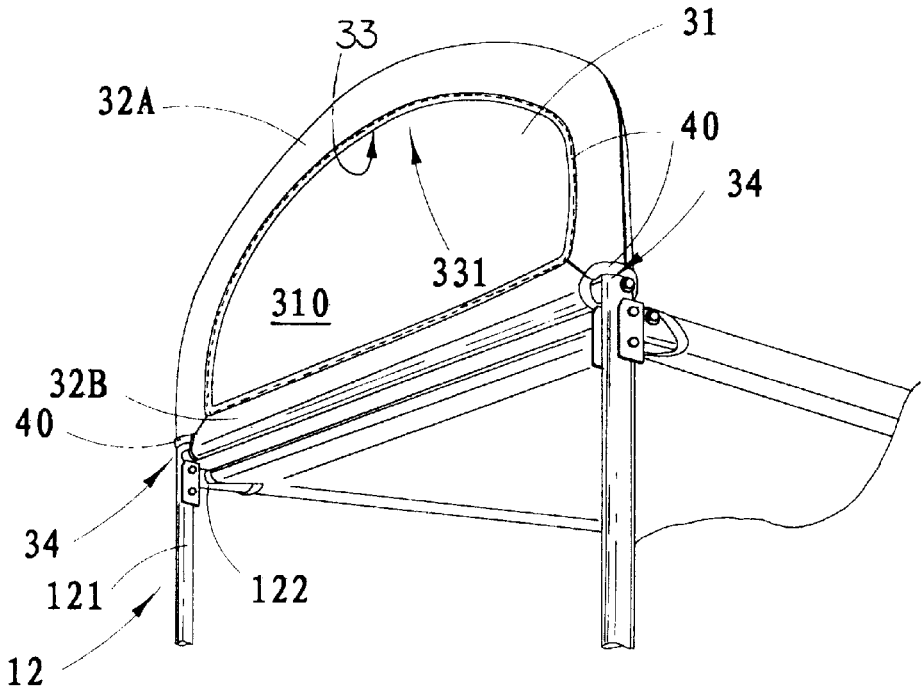
FIG. 6 is a perspective view of a side panel of the lightweight childbed according to the above preferred embodiment of the present invention.

As shown in FIG. 6, the first sheet 31 of the side panel 30 has a corresponding U-shaped upper portion and a horizontal lower portion to fit the side frame 12. The first and second sheets 31, 32 of the side panel 30 are overlappedly extended side to side together to define the receiving groove 33, which has a U-shaped cross section, between the first and second sheets 31, 32, such that the side panel 30 has ventilating ability and allows light passing through.

Accordingly, in order to form the receiving groove 33 to receive the boundary frame 11, the second sheet 32 has a U-shaped upper section 32A and a horizontal lower section 32B connected to the upper section 32A end to end wherein the upper section 32A of the second sheet 32 is firmly connected to the first sheet 31 and the lower section 32B of the second sheet 32 is integrally extended from the first sheet 31 by folding a bottom edge of the first sheet 31 to a rear surface thereof overlappedly.

Technically, two outer circumferential edges of the first sheet 31 and the upper section 32A of the second sheet 32 can be firmly attached with each other by stitching so that the receiving groove 33 is defined between the first and second sheets 31, 32 and the groove opening 331 is formed at an inner circumferential edge of the upper section 32A of the second sheet 32 for receiving a respective portion of the supporting post 121 of the side frame 12. Thus, the receiving groove 33 formed between the first sheet 31 and the lower section 32B of the second sheet 32 is arranged to receive the supporting pillar 122 of the side frame 12.

As shown in FIG. 6, the side panel 30 further has two edge notches 34 formed at two end connections of the upper and lower sections 32A, 32B respectively for registering with the side frame 12. Accordingly, the edge protecting straps 40 can also be attached to second sheet 32 and the edge notches 34 of the side panel 30 respectively wherein edges along the upper and lower sections 32A, 32B of the second sheet 32 and edges of the edge notches 34 are firmly attached with the edge protecting straps 40 to enhance the strength of the side panel 30.

Figure 7:
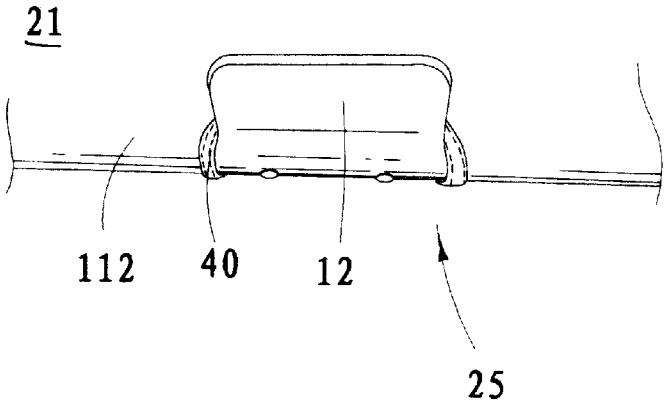
FIG. 7 is a perspective view of a mattress guider of the lightweight childbed according to the above preferred embodiment of the present invention.

As shown in FIG. 7, the bed frame 10 further comprises a pair of mattress guiders 13 upwardly extended from the two second supporting arms 112 of the boundary frame 11 for retaining a mattress M in position on the boundary frame 11, so as to prevent a lateral movement of the mattress M on the boundary frame 11, as shown in FIG. 2. Accordingly, the supporting panel 20 further has two side notches 25 provided on the first layer 21 and aligned with the mattress guiders 13 respectively for registering with the two mattress guiders 25 respectively in such a manner that, when the supporting panel 20 is mounted on the boundary frame 11, the two mattress guiders 13 are adapted to upwardly extend through the first layer 21. Besides, the edge protecting strap 40 is provided on an edge of each side notch 26. In other words, the edge protecting straps 40 are provided on edges of the supporting panel 20 and edges of the side panel 30 for strengthening the supporting panel 20 and the side panel 30 respectively, so as to prevent the supporting panel 20 and the side panel 30 from tearing off by the tensions applied thereon respectively.

It is worth to mention that the supporting panel 20 is strong enough to support a baby thereon within the tension surface 211. Preferably, the mattress M can be placed on the tension surface 211 to form the childbed for a young child supporting thereon. Due to the flexibility of the supporting plane 20, the downward force of the user's weight can be evenly distributed on the bed frame 10 so as to substantially support the user thereon.

What is claimed is:

1. A lightweight childbed, comprising:

a supporting panel comprising a first layer having a tension surface and a second layer overlapped with said first layer to define an edge holder, having a holder opening, between said first and second layers, wherein a tension of said tension surface is larger than a weight to be supported by said supporting panel, wherein said second layer is formed by folding four outer edges of said first layer to a bottom surface thereof overlappedly so as to form four edge sections of said second layer connected together end to end in such a manner that said four edge holders are formed between said four edge sections of said second layer and said first layer respectively while said holder opening opens inwardly;

at least a side panel comprising a first sheet having a tension portion and a second sheet overlapped with said first sheet to define a receiving groove, having a groove opening, between said first and second sheets; and a bed frame, comprising:

a boundary frame defining a central main window and having a size and shape adapted to be fittedly received in said edge holder so as to mount said first layer covering said main window to form said tension surface, wherein said boundary frame comprises two pairs of supporting arms connected end to end to form a rectangular structure that supports said supporting panel in a corresponding rectangular shape;

at least a side frame, which is mounted on a longitudinal side of said boundary frame, defining a central side window and having a size and shape adapted to be fittedly received in said receiving groove so as to mount said first sheet covering said side window to form said tension portion, wherein said side frame is firmly connected at two ends of said first pair of supporting arms; and a pair of mattress guiders upwardly extended from said two second supporting arms of said boundary frame for retaining a mattress on said boundary frame in position, wherein said supporting panel further has two side notches provided on said first layer for registering with said two mattress guiders respectively.

2. A lightweight childbed, comprising:

a supporting panel comprising a first layer having a tension surface and a second layer overlapped with said first layer to define an edge holder, having a holder opening, between said first and second layers, wherein a tension of said tension surface is larger than a weight to be supported by said supporting panel, wherein said second layer is formed by folding four outer edges of said first layer to a bottom surface thereof overlappedly so as to form four edge sections of said second layer connected together end to end in such a manner that said four edge holders are formed between said four edge sections of said second layer and said first layer respectively while said holder opening opens inwardly;

at least a side panel comprising a first sheet having a tension portion and a second sheet overlapped with said first sheet to define a receiving groove, having a groove opening, between said first and second sheets; and a bed frame, comprising:

a boundary frame defining a central main window and having a size and shape adapted to be fittedly received in said edge holder so as to mount said first layer covering said main window to form said tension surface;

at least a side frame, which is mounted on a longitudinal side of said boundary frame, defining a central side window and having a size and shape adapted to be fittedly received in said receiving groove so as to mount said first sheet covering said side window to form said tension portion; and a pair of mattress guiders upwardly extended from said two second supporting arms of said boundary frame for retaining a mattress on said boundary frame in position, wherein said supporting panel further has two side notches provided on said first layer for registering with said two mattress guiders respectively and four corner notches provided at four corners of said second layer for registering with said boundary frame, wherein each corner notch is formed at an end connection between two adjacent edge sections of said second layer.

3. A lightweight childbed, as recited in claim 2, further comprising a plurality of edge protecting straps provided on edges of said supporting panel and edges of said side panel respectively for strengthening said supporting panel and said side panel, so as to prevent said supporting panel and said side panel from tearing off by tensions applied thereon respectively.

4. A lightweight childbed, comprising:

a supporting panel comprising a first layer having a tension surface and a second layer overlapped with said first layer to define an edge holder, having a holder opening, between said first and second layers, wherein a tension of said tension surface is larger than a weight to be supported by said supporting panel, wherein said second layer is formed by folding four outer edges of said first layer to a bottom surface thereof overlappedly so as to form four edge sections of said second layer connected together end to end in such a manner that said four edge holders are formed between said four edge sections of said second layer and said first layer respectively while said holder opening opens inwardly;

at least a side panel comprising a first sheet having a tension portion and a second sheet overlapped with said first sheet to define a receiving groove, having a groove opening, between said first and second sheets; and a bed frame, comprising:

a boundary frame defining a central main window and having a size and shape adapted to be fittedly received in said edge holder so as to mount said first layer covering said main window to form said tension surface, wherein said boundary frame comprises two pairs of supporting arms connected end to end to form a rectangular structure that supports said supporting panel in a corresponding rectangular shape; and at least a side frame, which is mounted on a longitudinal side of said boundary frame, defining a central side window and having a size and shape adapted to be fittedly received in said receiving groove so as to mount said first sheet covering said side window to form said tension portion, wherein said side frame is firmly connected at two ends of said first pair of supporting arms; wherein said side frame comprises a U-shaped supporting post having two downwardly extending support stands firmly connected to two ends of said first supporting arms of said boundary frame and a supporting pillar transversely mounted between said two support stand of said supporting post, which supports said side panel.

5. A lightweight childbed, as recited in claim 4, wherein said first sheet of said side panel has a corresponding U-shaped upper portion and a horizontal lower portion to fit said side frame, and wherein said second sheet also has a U-shaped upper section overlappedly extended from said upper portion of said first sheet and a horizontal lower section overlappedly extended from said lower portion of said first sheet wherein said upper section of said second sheet is firmly connected to said lower section thereof end to end to form said receiving groove between said first and second sheets.

6. A lightweight childbed, as recited in claim 5 wherein two outer circumferential edges of said first sheet and said upper section of said second sheet are firmly attached with each other in such a manner said receiving groove formed between said first sheet and said upper section of said second sheet is arranged to fittedly receive said supporting post, and said lower section of said second sheet is formed by folding a bottom edge of said first layer to a rear surface thereof overlappedly in such a manner that said receiving groove formed between said first sheet and said lower section of said second sheet is arranged to fittedly receive said supporting pillar.

7. A lightweight childbed, as recited in claim 6, wherein said side panel further has two edge notches formed at two end connections of said upper and lower sections of said second sheet respectively for registering with said side frame.

8. A lightweight childbed, comprising:

a supporting panel comprising a first layer having a tension surface and a second layer overlapped with said first layer to define an edge holder, having a holder opening, between said first and second layers, wherein a tension of said tension surface is larger than a weight to be supported by said supporting panel, wherein said second layer is formed by folding four outer edges of said first layer to a bottom surface thereof overlappedly so as to form four edge sections of said second layer connected together end to end in such a manner that said four edge holders are formed between said four edge sections of said second layer and said first layer respectively while said holder opening opens inwardly;

at least a side panel comprising a first sheet having a tension portion and a second sheet overlapped with said first sheet to define a receiving groove, having a groove opening, between said first and second sheets; and a bed frame, comprising:

a boundary frame defining a central main window and having a size and shape adapted to be fittedly received in said edge holder so as to mount said first layer covering said main window to form said tension surface; and at least a side frame, which is mounted on a longitudinal side of said boundary frame, defining a central side window and having a size and shape adapted to be fittedly received in said receiving groove so as to mount said first sheet covering said side window to form said tension portion, wherein said side frame comprises a U-shaped supporting post having two downwardly extending support stands firmly connected to two ends of said first supporting arms of said boundary frame and a supporting pillar transversely mounted between said two support stand of said supporting post, which supports said side panel, wherein said supporting panel further has four corner notches provided at four corners of said second layer for registering with said boundary frame, wherein each corner notch is formed at an end connection between two adjacent edge sections of said second layer.

9. A lightweight childbed, as recited in claim 8, wherein said first sheet of said side panel has a corresponding U-shaped upper portion and a horizontal lower portion to fit said side frame, and wherein said second sheet also has a U-shaped upper section overlappedly extended from said upper portion of said first sheet and a horizontal lower section overlappedly extended from said lower portion of said first sheet wherein said upper section of said second sheet is firmly connected to said lower section thereof end to end to form said receiving groove between said first and second sheets.

10. A lightweight childbed, as recited in claim 9, wherein two outer circumferential edges of said first sheet and said upper section of said second sheet are firmly attached with each other in such a manner said receiving groove formed between said first sheet and said upper section of said second sheet is arranged to fittedly receive said supporting post, and said lower section of said second sheet is formed by folding a bottom edge of said first layer to a rear surface thereof overlappedly in such a manner that said receiving groove formed between said first sheet and said lower section of said second sheet is arranged to fittedly receive said supporting pillar.

11. A lightweight childbed, as recited in claim 10, wherein said side panel further has two edge notches formed at two end connections of said upper and lower sections of said second sheet respectively for registering with said side frame.

12. A lightweight childbed, as recited in claim 9, further comprising a plurality of edge protecting straps provided on edges of said supporting panel and edges of said side panel respectively for strengthening said supporting panel and said side panel, so as to prevent said supporting panel and said side panel from tearing off by tensions applied thereon respectively.

13. A lightweight childbed, as recited in claim 10, further comprising a plurality of edge protecting straps provided on edges of said supporting panel and edges of said side panel respectively for strengthening said supporting panel and said side panel, so as to prevent said supporting panel and said side panel from tearing off by tensions applied thereon respectively.

* * * * *